US011338341B2

(12) United States Patent
Vignolo et al.

(10) Patent No.: US 11,338,341 B2
(45) Date of Patent: May 24, 2022

(54) CLEANING PLANT FOR METAL PRODUCTS

(71) Applicant: Danieli & C. Officine Meccaniche S.P.A., Buttrio (IT)

(72) Inventors: Luciano Vignolo, Udine (IT); Alessandra Primavera, Faedis (IT); Gianfranco Marconi, Udine (IT)

(73) Assignee: DANIELI & C. OFFICINE MECCANICHE S.p.A., Buttrio (IT)

( * ) Notice: Subject to any disclaimer, the term of this patent is extended or adjusted under 35 U.S.C. 154(b) by 122 days.

(21) Appl. No.: 16/615,222

(22) PCT Filed: May 24, 2018

(86) PCT No.: PCT/IB2018/053689
§ 371 (c)(1),
(2) Date: Nov. 20, 2019

(87) PCT Pub. No.: WO2018/215966
PCT Pub. Date: Nov. 29, 2018

(65) Prior Publication Data

US 2020/0156131 A1 May 21, 2020

(30) Foreign Application Priority Data

May 24, 2017 (IT) ..... 102017000056336

(51) Int. Cl.
*B21B 45/06* (2006.01)
*C23G 3/02* (2006.01)

(52) U.S. Cl.
CPC ..... *B21B 45/06* (2013.01); *C23G 3/021* (2013.01); *C23G 3/028* (2013.01)

(58) Field of Classification Search
None
See application file for complete search history.

(56) References Cited

U.S. PATENT DOCUMENTS 4,872,245 A * 10/1989 Kawasaki ..... B21B 45/06 29/81.03
2003/0015259 A1 1/2003 Bunten et al.
2009/0002686 A1 1/2009 Voges et al.

FOREIGN PATENT DOCUMENTS

DE 3705603 1/1988
EP 0195385 9/1986
(Continued)

OTHER PUBLICATIONS

Meinhardt et al.: "Laser-Induced breakdown spectroscopy of scaled steel samples taken from cnotinouos casting blooms," Spectrochimica ACTA Part B, vol. 123, Aug. 2016, pp. 171-178.*
(Continued)

*Primary Examiner* — Mikhail Kornakov
*Assistant Examiner* — Pradhuman Parihar
(74) *Attorney, Agent, or Firm* — Stetina Brunda Garred & Brucker

(57) ABSTRACT

A plant for cleaning rolled metal strips provided with a superficial layer of oxide, the plant comprising unwinding means for unwinding at least one coil of rolled strip and pickling means for pickling said rolled strip; wherein there are provided measuring means for measuring the thickness of the superficial layer of oxide, arranged between said unwinding means and said pickling means. A relating cleaning method is also claimed.

10 Claims, 3 Drawing Sheets

(56) References Cited

FOREIGN PATENT DOCUMENTS

| | | |
|---|---|---|
| JP | H0754175 | 2/1995 |
| JP | 2003528978 | 9/2003 |

OTHER PUBLICATIONS

Meinhardt et al; Laser-induced breakdown spectroscopy of scaled steel samples taken from continuous casting blooms; article provided by applicant; Jan. 2016; Elsevier; Spectrochimica Acta Part B, 171-178.*

H. Balzer, M. Hoehne, V. Strum, R. Noll, Online coating thickness measurement and depth profiling of zinc coated sheet steel by laser-induced breakdown spectroscopy, Sep. 12, 2005, 7 pages.

Liao Shulun et al., Effect of Finish Rolling and Wire Coiling Temperature on Structure, Texture and Properties of 72A Tire Cord Steel Coil, Aug. 2014, pp. 59-61, vol. 35 No. 4, Special Steel.

Christoph Meinhardt, Volker Sturm, Rudiger Fleige, Cord Fricke-Begemann, Reinhard Noll; "Laser-Induced Breakdown Spectroscopy of Scaled Steel Samples Taken From Continuous Casting Blooms"; Elsevier; Aug. 14, 2016; pp. 171-178; vol. 123.

F. Boue-Bigne; "Analysis of Oxide Inclusions in Steel by Fast Laser-Induced Breakdown Spectroscopy Scanning: An Approach to Quantification"; Applied Spectroscopy; Mar. 1, 2007; pp. 333-337; vol. 61, No. 3.

* cited by examiner

CLEANING PLANT FOR METAL PRODUCTS

CROSS REFERENCE TO RELATED APPLICATION(S)

The present application claims priority to PCT International Application No. PCT/IB2018/053689 filed on May 24, 2018, which application claims priority to Italian Patent Application Nos. 102017000056336 filed May 24, 2017, the entirety of the disclosures of which are expressly incorporated herein by reference.

STATEMENT RE: FEDERALLY SPONSORED RESEARCH/DEVELOPMENT

Not Applicable.

FIELD OF THE INVENTION

The present invention relates to a cleaning plant for oxidized metal products.

BACKGROUND ART

The lines for cleaning strips of the conventional type aim at eliminating the superficial oxide layer which is formed on hot-rolled metal products. In fact, during the hot-rolling, the slabs, shaped by the continuous casting machine, are rolled and reduced in thickness so as to define a first strip of a thickness generally of between 0.8 and 12 mm.

Since the hot-rolling is carried out at high temperatures, generally of between 200 and 800° C., the surface of the metal product is exposed, in different sections, to oxidizing agents, such as air and water. In fact, it is not always possible to treat the metal strip in an inert atmosphere, and this causes the oxidation of the superficial layers of the product, which, in addition to determining a loss of weight of the material, is also a problem which will then have to be solved in a subsequent finishing process. This oxide layer is generally composed of ferrous oxide in the part closest to the metal, i.e. towards the inside, and of magnetite and hematite when moving away therefrom.

Furthermore, generally, the finishing process is not performed immediately downstream of the hot-rolling process. The hot-rolled strip is usually wound in coils of a desired weight or diameter (data depending on the strip thickness in output from the rolling line) and left to cool at room temperature in warehouses arranged near the hot-rolling line. This can therefore cause the further oxidation of the strip surfaces.

Furthermore, sometimes, the hot-rolling and the pickling occur at different sites, therefore, the strip coils can be transported even under conditions very aggressive from the point of view of corrosive attacks, for example in the presence of brackish air.

However, if this oxide layer, generally known as scale, is kept intact and adheres firmly to the metal strip, it performs a protective action for the metal strip. However, both due to the action of the atmospheric agents during transport and storage, and to the inevitable breakage of the scale itself, it is difficult to keep the oxide layer intact.

Furthermore, the humidity penetrates into the slits and reacts with the ferrous oxide layer closest to the metal surface, for example steel, forming ferrous and ferric hydroxides which, due to the increase in volume, cause a further detachment of the oxide layer, thus allowing the attack of another part of the metal.

Subsequently, depending on the production requirements, the hot-rolled strip shall be finalized in the finishing line.

Such strip can remain in the warehouse even for several days before being finalized, whereby, it has all the time to cool down and reach room temperature, determining oxide layers which, for example, can reach 5-20 μm per side of the strip. The thickness of the oxide is directly proportional to the nominal thickness of the strip, but also to the temperature of the strip during the winding thereof.

It is therefore required to clean the material from the oxide coat before performing the cold-rolling treatments of the product and the subsequent coating treatment (e.g., galvanizing or tinning). This is particularly important, since this oxide layer, or scale, can ruin the superficial quality of the finished product, in addition to making the rolling difficult.

Background art cleaning of the strip is performed by means of special layouts of the descaling and pickling line, which normally precede the cold-rolling. Usually, a hot-rolled strip unwinding line is provided, followed by a device adapted to break the scale, so as to make it more easily removable by means of following treatments. The cleaning of the product from the scale occurs by means of consecutive steps, which provide for the introduction of the product into acid tanks (pickling). Subsequently the product is rinsed.

Among the problems that this type of cleaning involves, certainly there is the considerable consumption and the subsequent disposal of the acids. Furthermore, the danger that chemical pickling entails with regard to the operators, both from the point of view of the management of corrosive liquids and from the point of view of any accidents, must be considered.

Disadvantageously, in the background art it is not known a priori what is the amount of scale present on the product before pickling it.

Therefore, operators currently assume the amount of initial scale to be removed on the basis of their experience.

As described above, the acid attack causes a loss of weight of the product passing through the pickling system.

However, although it is possible to determine the amount of product lost, it is not possible to optimize the cleaning parameters, since this control is performed ex-post, after having roughly assumed the amount of initial scale to be removed.

Currently, it is not possible to identify a priori the process parameters to remove the exact amount of oxide with the minimum amount of acid required. Disadvantageously, it is very likely that a greater amount of acid is used, thus also removing a part of the "good" product, i.e., a part of the base metal of the strip, so as to be certain of the good result of the cleaning.

On the contrary, in an even worse case, it is instead possible that the acid used (or the time spent in the pickling tanks) is not sufficient, and that, therefore, the product is not optimally cleaned and must, thus, be discarded or treated again.

In summary, two types of defects can occur in the pickling tanks:

- under-pickled material, with residual oxide stains present on the surface, usually the most persistent oxide not being removed by the pickling process, which can lead to the downgrading of the product;
- over-pickled material, in which the acid solution has also attacked the base metal of the strip, thus producing an evident thickness reduction and a strong modification of the superficial roughness. Even this defect can lead to the downgrading of the product.

Therefore, the need is felt to provide an innovative plant for cleaning metal strips, capable of overcoming the aforesaid drawbacks.

SUMMARY OF THE INVENTION

It is an object of the present invention to provide a plant for cleaning metal strips which allows to detect data which are useful for operators to best adjust the operational parameters of the pickling, making the latter more precise, cost effective, ecologically sustainable and safe.

It is a further object of the invention to provide a plant which allows to detect and process data to automatically adjust the operational parameters of the pickling, further improving the pickling conditions with respect to the solutions of the background art.

The present invention, therefore, meets at least one of the objects discussed above by means of a cleaning plant for cleaning metal strips, provided with a superficial layer of oxide, which, in accordance with claim 1, comprises unwinding means for unwinding at least one coil of rolled strip;

pickling means for pickling said rolled strip;

measuring means for measuring the thickness of the superficial layer of oxide, arranged between said unwinding means and said pickling means;

characterized in that said measuring means comprise at least one laser source cooperating with a fiber optic spectrometer, defining a LIBS system (Laser Induced Breakdown Spectroscopy) also adapted to analyze the composition of the oxide and the concentration of the constituents of the oxide.

Advantageously, said fiber optic spectrometer is adapted to measure the presence of oxygen while the laser of said laser source penetrates the rolled strip towards the non-oxidized base material.

A further advantage can be represented by the fact that there is provided a software, installed in the LIBS system, adapted to calculate the thickness of the superficial layer of oxide, i.e., adapted to calculate the depth of the layer of eroded material, by means of the laser source, at an erosion time t in which said spectrometer starts to detect the absence of oxygen, the rate of erosion by means of the laser being known. Preferably, said depth is calculated along a direction perpendicular to a plane defined by the advancing strip.

A further aspect of the invention relates to a method for cleaning metal strips, performable by means of the aforesaid plant, which, in accordance with claim 14, comprises the following steps:

unwinding at least one coil of rolled strip by means of the unwinding means;

measuring the thickness of the superficial layer of oxide of the strip by means of the measuring means;

pickling said rolled strip by means of the pickling means;

wherein, in step b), in addition to measuring the thickness of the superficial layer of oxide, also an analysis of the composition of the oxide and of the concentration of the constituents of the oxide is performed by means of at least one laser source associated with a fiber optic spectrometer, defining a LIB S system (Laser Induced Breakdown Spectroscopy);

and wherein said fiber optic spectrometer measures the presence of oxygen while the laser of said laser source penetrates the rolled strip towards the non-oxidized base material, and the thickness of the superficial layer of oxide is equal to the depth excavated in the rolled strip, by means of the laser source, when said spectrometer will detect the absence of oxygen. Therefore, during the punctual ablation of the oxide layer, performed by means of the laser source, the fiber optic spectrometer measures the presence of oxygen. When the spectrometer, after an erosion time t, therefore during the ablation, detects the absence of oxygen, the measurement of the depth of the layer of eroded material at the time t will correspond to the thickness of the superficial layer of oxide.

In other words, with the disappearance of the oxygen peak, once known the erosion time t and the erosion rate, a software calculates the erosion depth which will be equal to the thickness of the superficial layer of oxide. In addition, the LIBS system also provides information relating to the composition of the oxide (e.g., O/Fe ratio) allowing to further optimize the pickling conditions.

Advantageously, the solution of the invention allows to perform the measurement of the thickness of the superficial layer of oxide, and possibly also of the O/Fe ratio, in only 15 s÷20 s.

Advantageously, the precise measurement of the thickness of the oxide layer present on the rolled strip, provided upstream of the pickling means, allows the operators to suitably adjust the operational parameters of the pickling means. In fact, by precisely detecting, preferably but not necessarily just before the pickling, the thickness of the oxide layer, or thickness of the scale which has formed on the product to be cleaned, as well as the features thereof, it is much easier and safer to estimate the operational parameters of the cleaning devices and the amount of cleaning agents.

In a variant of the invention, the oxide layer thickness measurement data can be processed by a processing unit programmed to automatically adjust the operational parameters of the pickling means.

In all the variants it is possible to provide optical detection means for detecting data relating to the strip cleaning level, arranged downstream of said pickling means.

In the variant with the processing unit, the latter can be configured to also process the strip cleaning level data and, possibly, to further adjust the operational parameters of the pickling. In fact, by virtue of the feedback received from the optical detection means downstream of the pickling means, it is possible to control the quality of the cleaning obtained, further optimizing the parameters until the desired cleaning target is reached. Unlike what happens in the background art, in which the cleaning process is dictated by experience and is generally calibrated so as to perform a cleaning greater than required to ensure a sufficient result, by knowing the oxide starting data, being the pickling kinetics known, the optimal process conditions can be pre-set. With the analysis of the result in output from the pickling, it is possible to understand if the operational parameters of the pickling are optimal, sufficient or insufficient.

By virtue of the solution of the present invention it is therefore possible to optimize the management parameters of the pickling with respect to the actual product to be pickled, thus reducing the size of the machines, reducing or even eliminating cleaning systems using acids and saving base material of the metal product at the end of the cleaning.

In addition to reducing the pollutants and the energy costs of the system, a reduction in the risk for the health of the operators is further obtained.

The dependent claims describe preferred embodiments of the invention.

BRIEF DESCRIPTION OF THE FIGURES

Further features and advantages of the invention will become more apparent in light of the detailed description of preferred, but not exclusive, embodiments of a plant for cleaning metal strips, shown by way of explanation and not by way of limitation, with the aid of the accompanying drawings, in which.

The elements outlined with a dashed line are optional.

DETAILED DESCRIPTION OF EXEMPLARY EMBODIMENTS OF THE INVENTION

With reference to the Figures, some exemplary embodiments of a plant for cleaning oxidized metal strips are shown.

The plant according to the present invention, in all the embodiments thereof, comprises in sequence:

- unwinding means 1 for unwinding at least one coil of rolled strip having a superficial layer of oxide;
- measuring means 4, 4' for measuring the thickness of the superficial layer of oxide;
- pickling means 5 for pickling said rolled strip.

The unwinding means 1 comprise, in a first variant, a single unwinding line of the rolled strip, preferably a single unwinding reel.

In a second variant of the unwinding means 1, a double unwinding line for rolled strips is provided, followed by a cutting and welding machine so as to give continuity to the strip to be pickled.

In particular, at least two the unwinding reels and a welder, preferably a laser welder, can be provided, capable of producing junctions between the strips which are unwound by the unwinding reels, thus defining a continuous strip, i.e., allowing a metal strip feeding continuity downstream of the unwinding means. Optionally, a tensioning device for adjusting the strip tension can be provided.

Preferably, between the unwinding means 1 and the pickling means 5, at least one scale breaking device 3 can be advantageously provided, said scale breaking device using, for example, mechanical systems for breaking the oxide layer, so as to make this latter more removable by means of the subsequent pickling means.

Figure 2:
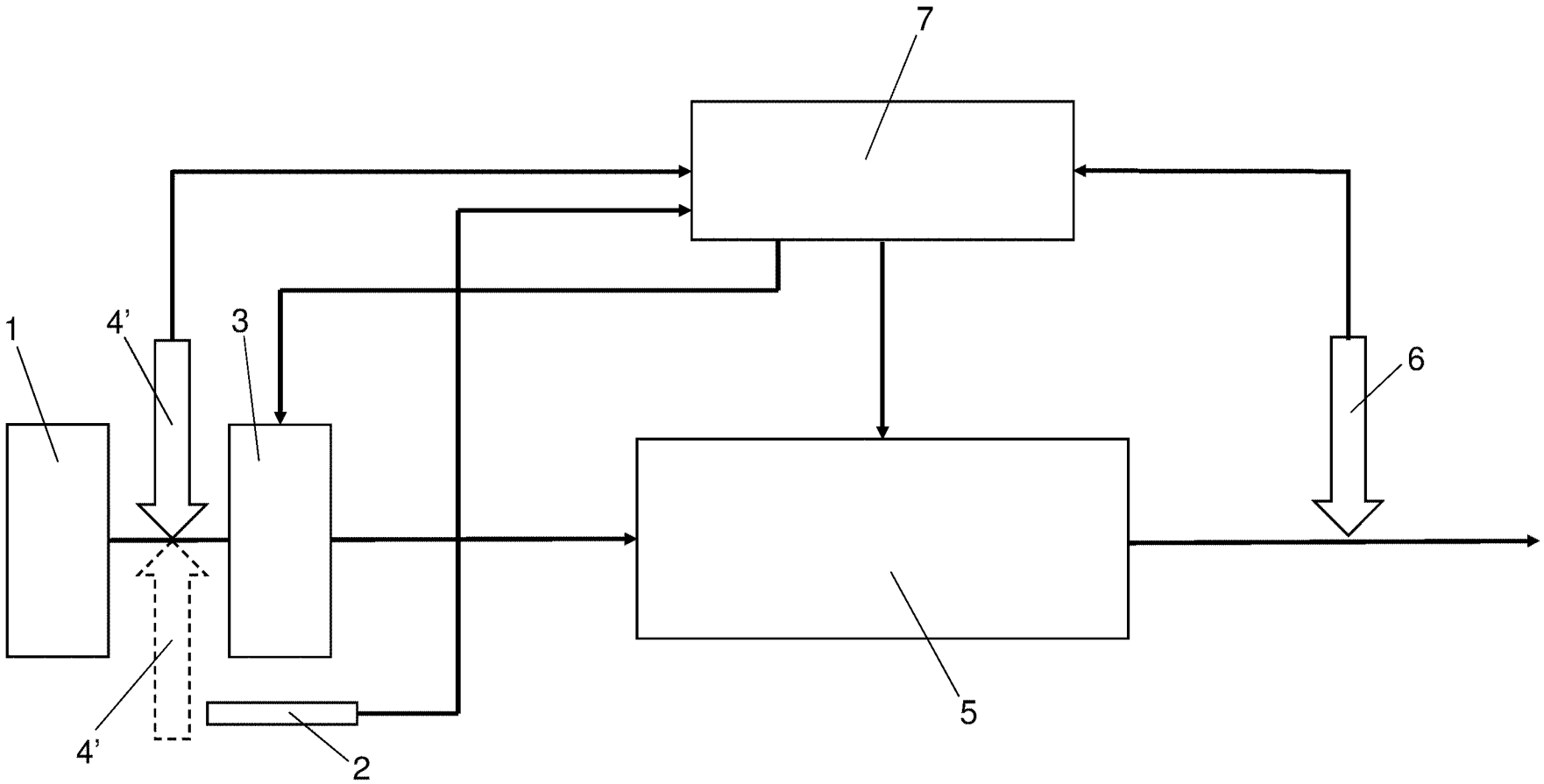
FIG. 2 shows a diagrammatic view of a second embodiment of a plant in accordance with the invention.

In a first embodiment (FIG. 2) the measuring means 4' for measuring the thickness of the oxide layer are arranged between the unwinding means 1 and the scale breaking device 3, so as to detect the input scale thickness and, therefore, to calibrate the scale breaking device 3 and, subsequently, the pickling means 5. Preferably, weight sensors 2 can advantageously be provided to weigh the amount of scales detached from the strip by means of the action of the scale breaking device 3. On the basis of the data detected by the measuring means 4' and on the basis of the weight of the scale detected by the weight sensors 2, the operator can better estimate the pickling operational parameters.

Figure 1:
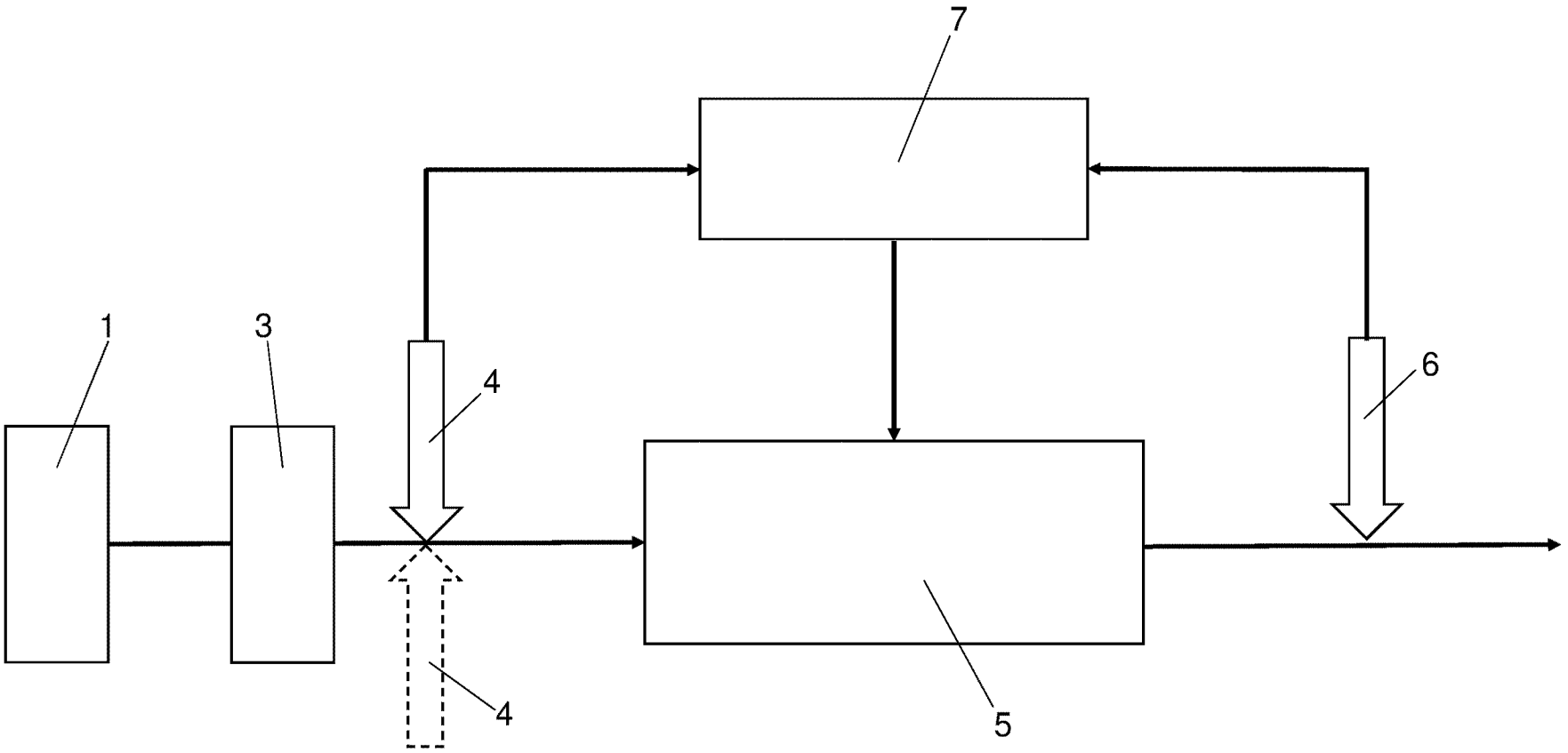
FIG. 1 shows a diagrammatic view of a first embodiment of a plant in accordance with the invention.

In a second embodiment (FIG. 1), the measuring means 4 for measuring the thickness of the oxide layer are arranged between the scale breaking device 3 and the pickling means 5. In this case, the thickness of the oxide layer in input to the pickling means 5 is detected and, therefore, only said pickling means are calibrated on the basis of the data detected by the measuring means 4. The scale breaking device 3 will therefore be set according to the experience of the operators, comparing the working parameters thereof to the thickness of the hot-rolled strips provided to the cleaning plant.

Figure 3:
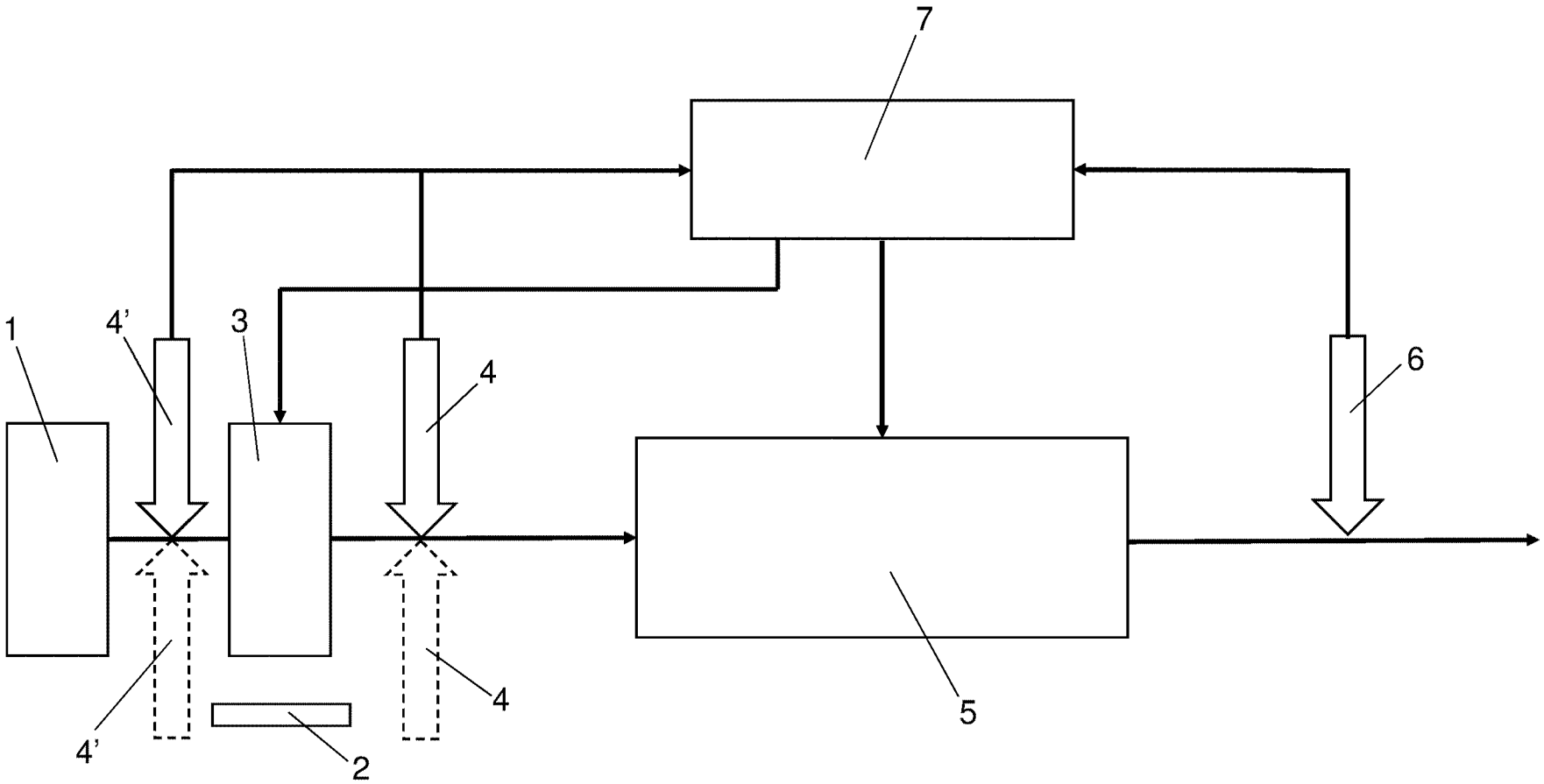
FIG. 3 shows a diagrammatic view of a third embodiment of a plant in accordance with the invention.

In a third embodiment (FIG. 3), first measuring means 4', arranged between the unwinding means and the scale breaking device 3, and second measuring means 4, arranged between the scale breaking device 3 and the pickling means 5, are instead provided. Thereby, by precisely knowing the data both in input to the scale breaking device 3 and in input to the pickling means 5, it is possible to obtain an optimal calibration of both units. Also in this third embodiment, weight sensors 2 can be provided to weigh the amount of scales detached from the strip by means of the action of the scale breaking device 3. On the basis of the data detected by the measuring means 4' and by the measuring means 4 and on the basis of the weight of the scale detected by the weight sensors 2, the operator can better estimate the pickling operational parameters.

Advantageously, the measuring means 4, 4' for measuring the thickness of the oxide layer comprise at least one laser source associated with a fiber optic spectrometer, defining a LIBS system (Laser Induced Breakdown Spectroscopy).

The LIBS system is not described in detail herein being a system known per se.

The spectrometer uses the laser source for the punctual ablation of the oxide layer. The laser source provides the energy required to bring the species belonging to the oxide layer, removed by the ablation along the thickness thereof, to the plasma state. The de-excitation of the ions constituting the plasma allows, by means of the use of the spectrometer, the identification of both the species present and the concentration thereof. The disappearance of the oxygen signal enables to easily find out the thickness of the oxide layer.

In fact, the spectroscopy measures the presence of the various elements starting from the external surface of the product, penetrating towards the non-oxidized base material. When the presence of oxygen is no longer detected, it means that the bottom of the oxide layer has been reached and that, therefore, the excavated depth corresponds to the measurement of the oxide thickness. By virtue of the spectrometric measurement, it is therefore possible to know both the thickness of the oxide layer and the composition thereof as well as the concentration of the constituents of the oxides. By virtue of these data, it becomes therefore possible to define the pickling operational parameters in an optimal manner A further advantage of the use of LIBS technology is due to the minimal invasiveness thereof, being a micro-destructive technology, since the only damage produced is the ablation of the material, creating a hole of a size which depends on the spot of the laser focused.

In an advantageous variant, two or more measuring means 4, 4' are provided, arranged above and below the rolled strip feed line, so as to calculate the thickness of the oxide layer both on the upper face and on the lower face of the strip, and the difference between the edge and the center of the strip.

In particular, in each area of the plant where the aforesaid measuring means are provided, at least one measuring means, arranged above the rolled strip feed line, and at least one measuring means, arranged below the rolled strip feed line, are provided.

When two or more measuring means 4', arranged between the unwinding means and the scale breaking device 3, and/or two or more measuring means 4, arranged between the scale breaking device 3 and the pickling means 5, are provided, at least four or more laser sources are provided, respectively associated with a fiber optic spectrometer, defining four or more LIBS systems.

These LIBS systems can be arranged in a fixed or in a movable manner with respect to the rolled strip feed line.

Measuring the thickness of the layer of oxide can be performed in different manners. For example, it is possible to perform the measurement in a static manner, temporarily interrupting the flow of material to the cleaning plant (for example during the welding of the strips) and restarting once obtained the data.

Alternatively, it is possible to perform the measurement continuously, for example by placing the measuring means on carriages adapted to be moved together with the metal strip.

In all the embodiments described above it is possible to provide, downstream of the pickling means 5, optical detection means 6 for detecting the strip cleaning level, so as to provide operators with information on the effectiveness of the pickling operational parameters previously set.

Preferably, rinsing means for rinsing the pickled strip are arranged between the pickling means 5 and the optical detection means 6.

It is also possible to provide a processing unit 7 configured to process measurement data originating from the measuring means 4 and/or 4' and to adjust operational parameters of the pickling means 5 and/or the scale breaking device 3.

Advantageously, the processing unit 7 can also be configured to process the strip cleaning level data, originating from the optical detection means 6, and possibly further adjusting the operational parameters of the pickling means 5.

The data originating from the measuring means 4, 4', comprising the values of the thickness of the oxide layers, the composition thereof and the concentration of the constituents of the oxides, are stored and processed in the processing unit 7 which will then determine, in particular, the operational parameters of the pickling means 5 and/or of the scale breaking device 3, then receiving a feedback on the pickling result by the optical detection means 6.

Such optical detection means 6 comprise, for example, at least one system for the video analysis of the strip downstream of the pickling, which will allow, for example, to compare the color or the brightness of the strip with chromatic scales indicating different cleaning degrees of the product, previously loaded in the memory of the processing unit 7. Using, for example, high pixel density digital cameras, it is possible to define the relationship between the defective area and the pickled area for each square meter of strip, the minimum and maximum size of the defective areas and the position thereof on the strip (upper surface/lower surface, center/edge, head/tail or coil body, i.e., the part of the strip between head and tail).

With regard to the pickling means, these can comprise at least one chemical pickling tank, or dry pickling systems, or dry pickling systems followed by at least one chemical pickling tank, or first dry pickling systems followed by second dry pickling systems.

In the event of pickling exclusively by means of one or more pickling tanks, it is provided that the flow of corrosive liquid, generally an acid, is best adjusted by the operators in the light of the data provided by the measuring means 4, or best adjusted directly by the processing unit 7.

In a preferred process variant, the strip, previously hot-rolled and oxidized, coming from the unwinding units or unwinding reels, and possibly treated by the scale breaking device 3, is subjected to the measurement of the thickness of the scale, preferably by means of LIBS, upstream of the pickling tanks. The operator or the processing unit 7 receives the data relating to the thickness detected on the two sides of the strip and on the edges and sets the process conditions relating to the complete pickling of the oxide layer which is more difficult to remove. This ensures the correct cleaning of the strip.

Furthermore, the operator and/or the processing unit can also know the thickness of the strip as loaded on the unwinding units, corresponding to the winding thickness of the strip at the end of the hot-rolling line. In fact, by knowing the amount of oxide to be removed, the mass balance of the chemical reaction to be carried out so as to completely eliminate the oxide layer can be pre-set. The data detected by the measuring means 4, 4' and the thickness of the strip at the time of the winding following the hot-rolling are therefore important to allow the operator or the processing unit to establish the amount of pickling acid adapted for such a strip thickness and for the relative thickness and type of oxide/scale, but, possibly, also the strip travel speed in the pickling tanks. In fact, for very oxidized products it is better to provide a lower travel speed (allowing a longer time of contact between acid and product); vice versa, for poorly oxidized products it is better to provide greater travel speeds.

As the acid attacks the oxides, causing the scale to detach from the product, said acid, once exhausted, joins to the oxides in the form of salts and is collected at the base of the pickling tanks by means of collection means.

By means of systems for measuring the concentration of iron Fe and acid placed at the inlet line of the new or regenerated liquid pickling solution, and at the outlet line of the exhausted solution, the amount of scale removed can be calculated by carrying out a precise process control.

The strip, therefore, proceeds to undergo the rinsing and to exit the pickling area. Once out, the strip is examined by the optical detection means 6 which verify the actual result of the previous pickling. In the event that insufficient cleaning is detected, the operator or the processing unit 7 can increase the amount of cleaning liquid, generally acid, or reduce the strip travel speed; vice versa, if the cleaning is excessive, the travel speed can be increased or the amount of cleaning liquid can be reduced.

In the event of pickling exclusively by means of a dry pickling apparatus, one or more laser cleaning devices are provided, adapted to emit concentrated beams of laser pulses, such as those disclosed in U.S. Pat. No. 5,736,709, which are best adjusted by the operators in view of the data provided by the measuring means 4, or best adjusted directly by the processing unit 7.

The use of this technology as a pickling system allows to eliminate the use of acids, allowing, on the one hand, an enormous simplification of the plant and, on the other hand, a management which is easier and more respectful of the environment.

In a preferred process variant, the strip, previously hot-rolled and oxidized, coming from the unwinding units or unwinding reels, and possibly treated by the scale breaking device 3, is subjected to the measurement of the thickness of the scale, preferably by means of LIBS, upstream of the dry pickling apparatus. The operator or the processing unit 7 receives the data relating to the thickness detected on the two sides of the strip and on the edges and sets the operational parameters of the dry pickling apparatus, such as, for example, the laser pulse energy on the different areas of the strip, so as to ensure the correct cleaning of the strip.

For a very precise cleaning, in the event of a plurality of laser cleaning devices, it is possible to provide further measuring means, preferably laser sources associated with a respective fiber optic spectrometer, each further measuring means being interposed between a laser cleaning device and the next one. Thereby, the strip is descaled by means of the single laser cleaning devices which work with the parameters set by the processing unit, or by the operator, following the measurement data of the oxide layer detected directly upstream of the single cleaning device.

Once the dry pickling operation is completed, the strip is examined by the optical detection means 6 which verify the quality of the cleaning.

The high power laser pulse, directed to the oxide layer, is maintained for a few moments, causing the surface to deform rapidly due to the high temperature, causing the scale, already weakened in the previous step, to detach. Furthermore, the most superficial oxide layer will tend to sublimate, while the inner one will undergo instantaneous heating, deforming in a different manner with respect to the underlying metal, given the different crystalline microstructure of the two components. This thermal shock, similar to a sound wave passing through the material, will cause the scale to separate from the strip base material.

Suction devices can be provided, possibly aided by brushing devices, to collect the oxide removed so as to weigh it and compare it with the initial data relating to the height of the oxide layer thickness and with what was expected to be removed.

Furthermore, this dry pickling apparatus has the advantage that, by collecting pure oxide, and not dirt from other materials, it allows the recovery thereof in other applications, for example, the sending to the melting furnaces or the sale on the market as scrap supplement.

An advantage of the combined use of the oxide layer thickness measuring means and of the laser dry pickling apparatus is the possibility of modulating the laser energy on the different parts of the strip, for example on the edges, so as to act with greater efficiency in the areas detected as with greater oxidation, without having to reduce the strip travel speed.

In the event of mixed pickling, by means of a dry pickling apparatus followed by at least one chemical pickling tank, one or more laser cleaning devices are provided, adapted to emit concentrated beams of laser pulses, such as, for example, those disclosed in U.S. Pat. No. 5,736,709, followed by at least one chemical pickling tank.

The operator and/or the processing unit 7 receives the data relating to the oxide thickness detected on the two sides of the strip and on the edges and sets the operational parameters of both the dry pickling apparatus, such as, for example, the laser pulse energy on the different areas of the strip, and the operational parameters of the chemical pickling, such as the amount of cleaning liquid, generally acid, and/or the strip travel speed.

Advantageously, using laser dry pickling to remove most of the oxide layer, and completing the operation with a light corrosive attack by means of acid, it is possible to act on the roughness of the product, obtaining an optimal surface, which will be particularly suitable for galvanization and/or painting treatments.

In fact, a large part of the oxide layer is eliminated by means of the laser treatment, but any superficial peaks remain unchanged; it is possible to uniform the surface, mediating the morphology thereof, by means of the corrosive action of the acid pickling.

Since the amount of corrosive liquid, in this case, is limited, the management thereof is much simpler and more easily treatable, also becoming more ecologically sustainable.

Finally, in the event of mixed pickling, by means of a first dry pickling apparatus followed by a second dry pickling apparatus, one or more laser cleaning devices are provided, adapted to emit concentrated beams of laser pulses, such as those disclosed in U.S. Pat. No. 5,736,709, followed by at least one mechanical pickling device, preferably provided with rotating abrasive brushes positioned at both the upper surface and the lower surface of the strip.

The operator or the processing unit 7 receives the data relating to the oxide thickness detected on the two sides of the strip and on the edges and sets the operational parameters of both the first dry pickling apparatus, such as, for example, the laser pulse energy on the different areas of the strip, and the operational parameters of the second dry pickling apparatus, such as the contact pressure of the brushes, the relative speed of the brushes with respect to the strip, the brush motor torque.

Advantageously, using laser dry pickling to remove most of the oxide layer, and completing the operation with a light removal of a superficial layer of material by means of the rotating brushes, it is possible to modify the superficial aspect of the product, controlling the superficial roughness thereof.

With regard to the method for cleaning the metal strips of the invention, performable by means of the aforesaid plant, such method comprises the following steps:

a) unwinding at least one coil of rolled strip by means of the unwinding means 1;

b) measuring the thickness of the superficial layer of oxide of the rolled strip by means of the measuring means 4, 4';

c) pickling said rolled strip by means of the pickling means 5;

wherein, in step b), the measurement of the thickness of the superficial layer of oxide is performed, together with an analysis of the composition of the oxide and of the concentration of the constituents of the oxide, by means of at least one laser source associated with a fiber optic spectrometer, defining a LIBS system (Laser Induced Breakdown Spectroscopy).

In the embodiment of the plant in which there are provided

- at least one scale breaking device 3 between the unwinding means 1 and the pickling means 5;
- first measuring means 4', arranged between the unwinding means 1 and the at least one scale breaking device 3;
- second measuring means 4 arranged between the at least one scale breaking device 3 and the pickling means 5;
- optical detection means 6 for detecting the strip cleaning level, arranged downstream of said pickling means 5;
- and a processing unit 7 for processing measurement data, originating from said first measuring means 4' and said second measuring means 4, and strip cleaning level data, originating from said optical detection means 6;

the method, after the step a), provides of:

- measuring the thickness of the superficial layer of oxide of the rolled strip by means of the first measuring means 4';
- processing, by means of the processing unit 7, measurement data originating from said first measuring means 4', and adjusting operational parameters of said at least one scale breaking device 3;
- descaling the rolled strip by means of said at least one scale breaking device 3;
- measuring the thickness of the superficial layer of oxide of the rolled strip by means of the second measuring means 4;

processing, by means of the processing unit 7, measurement data originating from said second measuring means 4, and adjusting operational parameters of said pickling means 5;

pickling said rolled strip by means of the pickling means 5;

detecting the rolled strip cleaning level by means of the optical detection means 6;

processing, by means of the processing unit 7, strip cleaning level data, originating from said optical detection means 6, and possibly further adjusting said operational parameters.

The invention claimed is:

1. A cleaning plant for cleaning rolled metal strips provided with a superficial layer of oxide, the plant comprising: unwinding means for unwinding at least one coil of rolled strip; pickling means for pickling said rolled strip; measuring means for measuring a thickness of the superficial layer of oxide, said measuring means being arranged between said unwinding means and said pickling means; characterized in that said measuring means comprises at least one laser source cooperating with a fiber optic spectrometer, defining a LIBS system (Laser Induced Breakdown Spectroscopy) also adapted to analyze a composition of the oxide and a concentration of constituents of the oxide, said fiber optic spectrometer being adapted to measure a presence of oxygen while a laser of said at least one laser source penetrates the rolled strip towards a non-oxidized base material; wherein at least one scale breaking device is provided between the unwinding means and the pickling means; wherein there are provided weight sensors to weigh an amount of scales detached from the rolled strip by means of the at least one scale breaking device and suction devices aided by brushing devices, to collect the oxide detached so as to weigh said oxide.

2. The cleaning plant according to claim 1, wherein said measuring means are arranged between the at least one device for breaking scale and the pickling means or between the unwinding means and the at least one device for breaking scale.

3. The cleaning plant according to claim 1, wherein there are provided first measuring means, arranged between the unwinding means and the at least one device for breaking scale, and second measuring means arranged between the at least one device for breaking scale and the pickling means.

4. The cleaning plant according to claim 1, wherein, in each area of the cleaning plant where there are provided said measuring means, at least one measuring means is arranged above a rolled strip feed line and at least one further measuring means is arranged below the rolled strip feed line.

5. The cleaning plant according to claim 1, wherein there is provided a processing unit for processing measurement data originating from said measuring means and adjusting operational parameters of said pickling means.

6. The cleaning plant according to claim 5, wherein there are provided optical detection means for detecting a strip cleaning level, said optical detection means being arranged downstream of said pickling means.

7. The cleaning plant according to claim 6, wherein said processing unit is configured to process strip cleaning level data originating from said optical detection means, and possibly further adjust operational parameters of said pickling means.

8. The cleaning plant according to claim 1, wherein said pickling means comprise at least one chemical pickling tank, or dry pickling systems, or dry pickling systems followed by at least one chemical pickling tank, or first dry pickling systems followed by second dry pickling systems.

9. The cleaning plant according to claim 8, wherein said dry pickling systems are laser pickling devices and/or mechanical pickling devices.

10. The cleaning plant according to claim 1, wherein there is provided a software, installed in the LIBS system and adapted to calculate the thickness of the superficial layer of oxide, defined by a depth of a layer of eroded material, by means of the at least one laser source, at an erosion time in which said fiber optic spectrometer starts to detect absence of oxygen, an erosion rate by means of the laser being known.

* * * * *